United States Patent [19]

Seeman et al.

[11] 4,334,258

[45] Jun. 8, 1982

[54] EXPLOSION PREVENTION CONTROL SYSTEM FOR A FUEL-GAS BURNING AUTOMATIC IGNITION APPLIANCE AND ASSOCIATED GAS DISTRIBUTION SYSTEM

[76] Inventors: Jeffrey L. Seeman, 263 Lakeview Ave., Brightwaters, N.Y. 11718; James A. Dionian, 133 Moody Ave., Islip, N.Y. 11751

[21] Appl. No.: 161,663

[22] Filed: Jun. 23, 1980

[51] Int. Cl.[3] ..... F23N 5/24

[52] U.S. Cl. ..... 361/170; 431/22

[58] Field of Search ..... 361/170; 340/632; 431/22; 48/192

[56] References Cited

U.S. PATENT DOCUMENTS

| | | | |
|---|---|---|---|
| 3,609,732 | 9/1971 | Kasahara | 361/170 |
| 3,744,954 | 7/1973 | Faulkner | 431/22 |
| 3,766,441 | 10/1973 | Gray | 361/170 |
| 4,171,944 | 10/1979 | Hirschmann | 431/22 |
| 4,209,291 | 6/1980 | Gandolfi et al. | 431/22 |
| 4,219,806 | 8/1980 | Enemark | 340/632 |
| 4,245,978 | 1/1981 | de Valle | 431/22 |

FOREIGN PATENT DOCUMENTS

| | | | |
|---|---|---|---|
| 2710940 | 9/1978 | Fed. Rep. of Germany | 431/22 |
| 611083 | 5/1978 | U.S.S.R. | 431/22 |

*Primary Examiner*—J. D. Miller
*Assistant Examiner*—L. C. Schroeder
*Attorney, Agent, or Firm*—McAulay, Fields, Fisher, Goldstein & Nissen

[57] ABSTRACT

An explosion prevention control system is provided for automatic ignition fuel-gas burning appliances to sample the atmosphere and, in response to a predetermined level of fuel-gas in the atmosphere, to deactivate the automatic ignition apparatus in the appliance and block the flow of fuel-gas in the gas distribution system.

An alarm can be provided to indicate that the control system is responding to fuel-gas concentrations in the atmosphere.

A latch-off switch can be provided for the automatic ignition apparatus to ensure that the automatic ignition apparatus remains deactivated until the latch-off switch is reset.

11 Claims, 3 Drawing Figures

EXPLOSION PREVENTION CONTROL SYSTEM FOR A FUEL-GAS BURNING AUTOMATIC IGNITION APPLIANCE AND ASSOCIATED GAS DISTRIBUTION SYSTEM

BACKGROUND OF THE INVENTION

The present invention is an explosion prevention system for use with gas burning appliances of the type having automatic ignition apparatus integral therewith. More specifically, the present invention is a system which continuously samples the atmosphere and, in response to the potentially explosive presence of fuel-gas, automatically blocks passage of gas into the gas distribution system and simultaneously disables the appliance ignition apparatus to attenuate the danger of an explosion.

The high cost of energy has made it incumbent on energy users to investigate the feasibility of use of various fuels, depending on cost and local availability. Because they are easily interchangeable, with respect to distribution systems and combustion devices, various fuel-gases have been considered. Although fuel-gases often have favorable cost factors when compared with normally liquid petroleum products, the danger of explosion from leaking fuel is generally greater.

Depending on geographic location, one particular fuel-gas, propane, has been found to have a favorable cost per B.T.U. factor compared with other gases, in part because it can be inexpensively shipped in liquefied form under pressure. However, this fuel-gas product suffers from a disadvantage over other gases in that it is heavier than air and thus more likely to be contained in a cellar enclosure. If leakage occurs, an explosion is almost inevitable if the accumulation goes unnoticed. With lighter than air gases, an explosive accumulation is also an ever present hazard especially where ventilation is minimal or lacking altogether.

Although gas detector alarms are known, these devices fail to provide the necessary safeguards for use with gas appliances. Gas detector alarms provide an indication of a potential hazard but do nothing to attenuate the hazard. It is important that fuel leakage be stopped and any automatic ignition devices be disabled. This will prevent further dangerous accumulations of gas, and also prevent explosive ignition of the already accumulated gas, by the gas appliance ignition system.

We are unaware of any system which simultaneously closes off the fuel supply and disables the appliance ignition system, thus to stop any leakage and prevent accidental ignition of accumulated gases. Just closing off the fuel supply will stop the leak and eventually cause most appliances to eventually shut off, due to internal safety control. However, appliance safety controls normally operate by activating the ignition device and sensing if a flame is present. If no flame occurs, for example if no fuel is available, the safety controls will shut down the system. As is readily evident, if a fuel gas has accumulated in the area of the appliance, the appliance ignition system can ignite it to cause an explosion. On the other hand, if only the appliance ignition system is disabled, the gas will continue to leak and may be accidentally ignited by other means than the appliance. An alarm by itself serves only to warn of danger but does nothing to alleviate the possibility of an explosion. Thus, in order to prevent an explosion from gas leakage, one must stop the leak and disable possible sources of ignition.

BRIEF DESCRIPTION

Briefly, the preferred embodiment of the present invention is a safety control system for a fuel-gas burning appliance and associated gas distribution system. The safety control includes means to sense the presence of gas outside the distribution system. In response to the presence of gas, the safety control generates a control signal which is operable to disable the appliance ignition system and simultaneously to shut off the fuel-gas distribution system. An appropriate alarm or alarms can also be activated if desired.

A gas sensor provides a sensing signal to a control, in response to the presence of fuel-gas. In response to the sensing signal, the control provides the control signal.

A solenoid valve in the fuel distribution system is connected to the control and closes the system in response to the control signal.

The appliance is also connected to the control, the ignition of the appliance being adapted to be shut off by the control signal. A latch-off safety switch is preferably used for this function. Once deactivated by the control signal, the latch-off safety switch requires manual resetting. This prevents premature activation of the ignition system.

Simultaneous deactivation of the appliance and distribution system is thereby attained.

A bell or other alarm is preferably used to indicate the operation of the system. The alarm is connected to the control and is adapted to be triggered by the control signal.

DESCRIPTION OF THE PREFERRED EMBODIMENT

Figure 1:
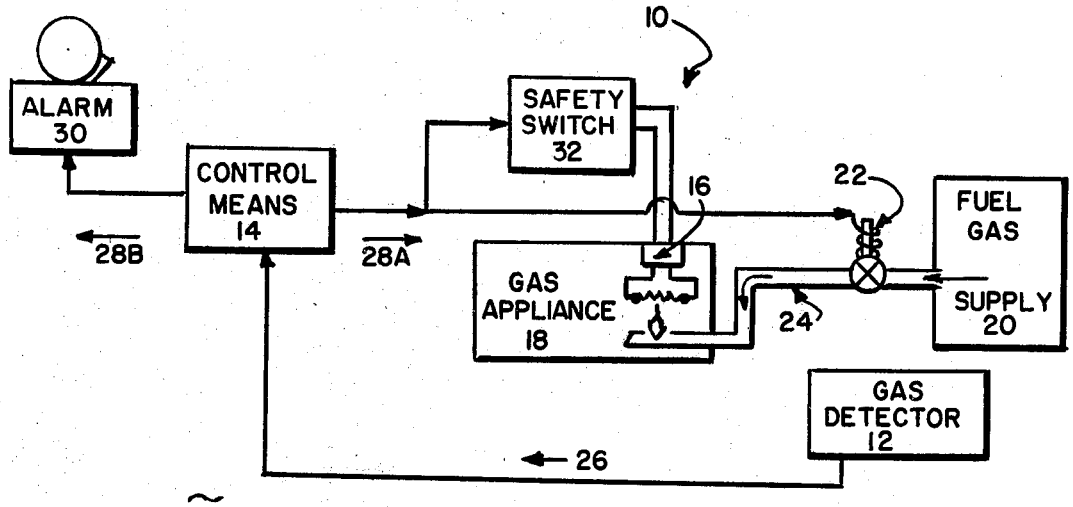
FIG. 1 is a schematic and block diagram of a system according to the present invention.

The preferred embodiment of the present invention system 10 as illustrated in FIG. 1 combines a gas detector 12 with a control means 14 and various control devices. These operate to deactivate the ignition device 16 of the gas appliance 18 and simultaneously to turn off the fuel gas supply 20, in response to the presence of fuel gas at the gas detector 12.

The gas detector 12 is preferably a commercially available alarm-type unit such as "FIRST ALERT" (Pitway, Ind.), the alarm output (nominally 9 volts) of which is used as an alarm signal for the present invention system. These units are generally self-contained and designed to be mounted near the appliance or at other appropriate locations to detect possible gas leaks. Thus, for example, for a gas furnace installation in the basement of a home, the gas detector will be mounted near the basement floor or ceiling depending on whether heavier- or lighter-than-air gases are used. These considerations are also appropriate for the present invention.

As illustrated in FIG. 1, a solenoid activated valve 22 is disposed near the inlet of the fuel gas distribution system 24, and controls the flow of gas into the gas distribution system. The alarm signal 26 from the gas detector unit 12 is applied to a control means 14 which converts it to a control signal 28. The control signal 28 is applied simultaneously to the ignition device 16 and the solenoid activated valve 22 to block the fuel supply and deactivate the ignition device 16. The control signal 28 is also applied to an alarm 30, if one is used. Further, as shown in FIG. 1, a safety switch 32 is used in the control circuit to the gas appliance 18. This is a latch-off type switch to control the power to the ignition device 16 and requires resetting before it is reactivated.

Figure 2:
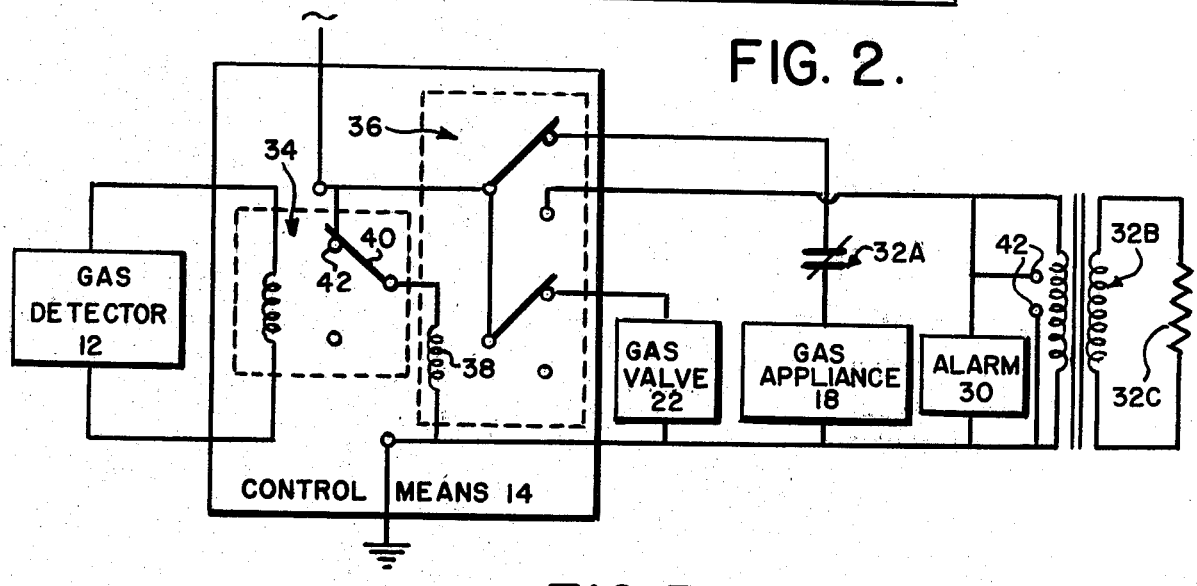
FIG. 2 is an electric schematic and block diagram of a system according to the present invention in a neutral or non-activated condition.
Figure 3:
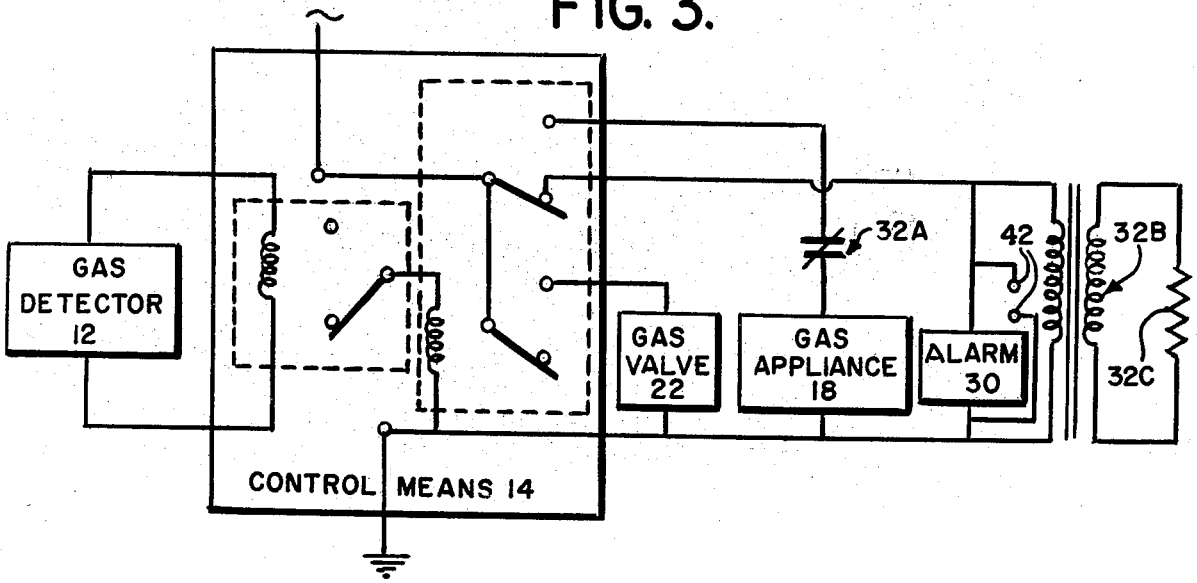
FIG. 3 is an electric schematic and block diagram similar to FIG. 2 with the system activated in response to the presence of fuel-gas vapor.

More particularly, and as illustrated in FIGS. 2 and 3, the control means 14 preferably comprises a switching relay 34 and a power relay 36. The alarm signal 26 generated by gas detector 12 is applied to switching relay 34. Switching relay 34 in turn is connected to and switches power relay 36, which controls the various elements of the system 10, as will be discussed in detail below. This dual relay 34, 36 arrangement is presently preferred in order that the relatively low power alarm signal from the commercially available gas detector 12 can be used to switch the power required by the present invention system. For the Pitway unit noted above, the output is a low power signal at about 9 volts D.C. More positive control of the power relay 36 using a low power signal is accomplished by the two stage relay switching arrangement. As would be obvious, other relay or equivalent switching devices can be employed to convert the alarm signal from the gas detector 12 to a control signal for the system. For convenience of manufacture and handling, the switching devices and other components that may be employed in the control means 14 is mounted on a printed circuit board either separately or with the gas detector 12 circuits included.

Power relay 36 is shown as a double-pole-double-throw (D.P.D.T.) type relay wherein a separate relay contact is used for each element to be switched. For the basic circuit shown in FIGS. 2 and 3, if desired, a single-pole-double-throw (S.P.D.T.) type relay can be substituted, if each parallel element can utilize the same control signal.

FIG. 2 illustrates th invention in a non-alarm or normal mode. In the preferred operating mode shown in FIG. 2, power relay 36 has power applied to its switching coil 38 through normally closed contacts 40, 42 of inactivated switching relay 34, to switch the relay 36. Relay 36, in turn, generates a control signal 28A in the form of the power supply to the gas appliance 18 and to the solenoid activated gas valve 22. This switches the gas valve 22 to its open state to provide fuel to gas appliance 18, and electric power to the gas appliance ignition system 16 to allow the gas appliance to operate normally.

In the event of a gas leak, gas leak detector 12 generates an alarm signal 26 which is applied to the switching coil 40 of switching relay 34. This causes contacts 40, 42 to open, breaking the circuit to power relay switching coil 38. Power relay 36 will switch to its alarm position as shown in FIG. 3 to stop the control signal 28A to the gas appliance 18 and the gas valve 22, and generate a new control signal 28B directed to an alarm 30. This will simultaneously deactivate the appliance 18 and cause the gas valve 22 to close. In addition, a control signal 28B will be applied to the alarm 30. This closes off the fuel supply and prevents the ignition system 16 of gas appliance 18 from accidentally setting off an explosion of the leaked gas. The alarm 30 is for the convenience of the system user, to warn that the system has been activated and a possible danger from leaking gas is present. The alarm 30 may take any convenient and useful form, depending on the circumstances. A bell and flashing light combination alarm is probably the most useful type of alarm although it is contemplated that bed vibrators (for the deaf) and other specialized types of alarms can also be activated. For this reason, a set of alarm control signal output terminals 42 are preferably included in the device wired in parallel with the alarm 30.

Another important fail-safe feature of the present invention is the provision of a safety switch 32 connected between the control means 14 and the gas appliance 18. Safety switch 32 is a latch-off type switch preferably of the type wherein a heater element 32C will cause the contacts 32A of the switch 32 to open until the contacts are manually reset. As shown in FIGS. 2 and 3, heater element 32C is supplied the required power from a transformer 32B connected in parallel with alarm 30. Thus, after the alarm 30 has been activated a predetermined time, switch 32 will open and even if the system 10 is switched to the non-activated condition shown in FIG. 2, the gas burner will require manual resetting.

What is claimed is:

1. In a fuel-gas burning appliance system of the type including a fuel-gas burning appliance having an electrically activated automatic ignition device, and a fuel-gas supply distribution arrangement including a conduit for conducting fuel-gas from a fuel-gas supply to the appliance, the improvement comprising:

gas sensing means disposed outside of said distribution system and being operable to generate a sensing signal in response to the presence of fuel-gas;

control means coupled to said gas sensing means to generate a control signal in response to said sensing signal;

a latch-off safety switch connected to said ignition device and operable in response to said control signal to deactivate and maintain deactivated said ignition device until said switch receives a reset signal, reactivation of said ignition device being prevented until said reset signal is received by said switch, and a distribution system gas shut-off valve disposed in said conduit and being switchable between an open state in which fuel-gas is permitted to pass through said conduit and a closed state in which fuel-gas is blocked from passage through said conduit, said shut-off valve including switching means connected to said control means and adapted to switch said control valve from said open to said closed state in response to said control signal;

whereby the presence of fuel-gas outside said distribution system at said gas sensing means will cause said fuel-gas burning appliance ignition system to be deactivated and the fuel supply to be shut off.

2. The system of claim 1 wherein said switch includes a manual reset device operable to generate said reset signal.

3. The system of claim 1 further comprising an alarm, said alarm being connected to said control means and adapted to be activated by said control signal.

4. The system of claim 3 wherein said shut-off valve is a solenoid activated valve.

5. An explosion prevention control system for a fuel gas burning appliance having an automatic ignition device and its associated fuel-gas distribution arrangement having a supply conduit connected to the appliance and a shut-off valve in the conduit, said control system comprising:

gas sensing means to be disposed outside the fuel-gas distribution arrangement and being operable to generate a sensing signal in response to the presence of fuel-gas;

control means coupled to said gas sensing means and operable to generate a control signal in response to said sensing signal, said control signal being adapted to close the shut-off valve in the conduit;

a latch-off safety switch adapted to be connected to said ignition device and operable in response to said control signal to deactivate and maintain deactivated the ignition device until said switch receives a reset signal, reactivation of said ignition device being presented until said reset signal is received by said switch.

6. The system of claim 5 wherein said switch includes a manual reset device operable to generate said reset signal.

7. The system of claim 5 further comprising an alarm, said alarm being connected to said control means and adapted to be activated by said control signal.

8. An explosion prevention control system for a fuel-gas burning automatic ignition appliance and its associated fuel-gas distribution arrangement with a supply conduit connected to the appliance, said control system comprising:

gas sensing means disposed outside of said distribution system and being operable to generate a sensing signal in response to the presence of fuel-gas;

control means coupled to said gas sensing means to generate a control signal in response to said sensing signal;

a latch-off switch operable to be connected to the automatic ignition device and adapted to respond to said control signal by deactivating and maintaining deactivated said ignition device until said switch receives a reset signal, reactivation of said ignition device being prevented until said reset signal is received by said switch; and a distribution system shut-off valve disposed in said conduit and being switchable between an open state in which fuel-gas is permitted to pass through said conduit and a closed state in which fuel-gas is blocked from passage through said conduit, said shut-off valve including switching means connected to said control means and adapted to switch said control valve from said open to said closed state in response to said control signal;

whereby the presence of fuel-gas outside said distribution system at said gas sensing means will cause said fuel-gas burning appliance ignition system to be deactivated and the fuel supply to be shut off.

9. The system of claim 8 wherein said switch includes a manual reset device operable to generate said reset signal.

10. The system of claim 8 further comprising an alarm, said alarm being connected to said control means and adapted to be activated by said control signal.

11. The system of claim 10 wherein said shut-off valve is a solenoid activated valve.

* * * * *